US012467227B2

(12) United States Patent
Nishihara et al.

(10) Patent No.: US 12,467,227 B2
(45) Date of Patent: Nov. 11, 2025

(54) WORK MACHINE AND METHOD FOR CONTROLLING WORK MACHINE

(71) Applicant: KOMATSU LTD., Tokyo (JP)

(72) Inventors: Ken Nishihara, Tokyo (JP); Eiji Ishibashi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 94 days.

(21) Appl. No.: 18/554,702

(22) PCT Filed: May 31, 2022

(86) PCT No.: PCT/JP2022/022150
§ 371 (c)(1),
(2) Date: Oct. 10, 2023

(87) PCT Pub. No.: WO2023/276529
PCT Pub. Date: Jan. 5, 2023

(65) Prior Publication Data

US 2024/0044104 A1 Feb. 8, 2024

(30) Foreign Application Priority Data

Jun. 30, 2021 (JP) ..... 2021-108991

(51) Int. Cl.
*E02F 3/84* (2006.01)
*E02F 9/26* (2006.01)

(52) U.S. Cl.
CPC ..... *E02F 3/844* (2013.01); *E02F 9/265* (2013.01)

(58) Field of Classification Search
CPC ... E02F 3/85; E02F 9/262; E02F 3/844; E02F 9/265; E02F 3/845; E02F 3/7622
(Continued)

(56) References Cited

U.S. PATENT DOCUMENTS 5,950,141 A * 9/1999 Yamamoto ..... E02F 9/2029 702/41
5,996,703 A * 12/1999 Yamamoto ..... E02F 9/2285 172/7

(Continued)

FOREIGN PATENT DOCUMENTS

CN 1137121 C * 2/2004 ..... C07D 333/24
CN 111622293 A 9/2020

(Continued)

OTHER PUBLICATIONS

Mononen, Teemu, Jouni Mattila, and Mohammad M. Aref. "High-level controller for high productivity earthmoving by tracked bulldozers." Fluid Power Systems Technology. vol. 83754. American Society of Mechanical Engineers, 2020. (Year: 2020).*

(Continued)

*Primary Examiner* — Cuong H Nguyen
(74) *Attorney, Agent, or Firm* — GLOBAL IP COUNSELORS, LLP

(57) ABSTRACT

A work machine includes a vehicle body including a travel device, a blade supported so as to be rotatable about a pitch axis with respect to the vehicle body, a pitch actuator configured to cause the blade to perform a pitch motion about the pitch axis, and a controller. The determines whether a slip occurs on the travel device during work with the blade, and causes the blade to perform the pitch motion in a backward tilt direction upon determining that the slip occurs.

6 Claims, 9 Drawing Sheets

(58) Field of Classification Search
USPC ..... 37/413–414; 701/50
See application file for complete search history.

(56) References Cited

U.S. PATENT DOCUMENTS

| | | | | |
|---|---|---|---|---|
| 6,317,676 | B1 * | 11/2001 | Gengler | E02F 9/2029 701/50 |
| 11,268,259 | B2 * | 3/2022 | Harada | E02F 9/262 |
| 11,371,218 | B2 * | 6/2022 | Ishibashi | E02F 9/265 |
| 2020/0056353 | A1 | 2/2020 | Ishibashi et al. | |
| 2020/0277750 | A1 | 9/2020 | Heo et al. | |
| 2021/0285186 | A1 * | 9/2021 | Ishibashi | E02F 9/262 |
| 2024/0150996 | A1 * | 5/2024 | Tanaka | E02F 9/22 |

FOREIGN PATENT DOCUMENTS

| | | | | |
|---|---|---|---|---|
| EP | 1137121 | A1 * | 9/2001 | H01R 13/6456 |
| EP | 3324017 | B1 * | 1/2023 | F01N 13/009 |
| JP | 55-3503 | B2 | 1/1980 | |
| JP | 58-123932 | A | 7/1983 | |
| JP | 63-210315 | A | 9/1988 | |
| JP | 2018-197425 | A | 12/2018 | |
| WO | WO-0118915 | A1 * | 3/2001 | H01R 13/6456 |
| WO | WO-2018084029 | A1 * | 5/2018 | E02F 9/262 |

OTHER PUBLICATIONS

Saveliev, A. G., and V. A. Mikhailovskaya. "Ultimate loads, arising on the blade during exploitation, according to existed design positions for calculations." IOP Conference Series: Materials Science and Engineering. vol. 786. No. 1. IOP Publishing, 2020. (Year : 2020).*

Vento, Calixto Domínguez, et al. "Machinery for direct sowing of rice in agricultural conditions." International Journal of Food Science and Agriculture 5.3 (2021). (Year: 2021).*

Ozaki, Ryota, et al. "Blade Control for Bulk Dozer Push by Bulldozer using Reinforcement Learning." IECON 2024—50th Annual Conference of the IEEE Industrial Electronics Society. IEEE, 2024. (Year: 2024).*

Mononen, Teemu, Antti Kolu, and Jouni Mattila. "Semi-autonomous bulldozer blade control using real-time terrain mapping." 2022 IEEE/ASME International Conference on Advanced Intelligent Mechatronics (AIM). IEEE, 2022. (Year: 2022).*

Khan, Subhan, and Jose Guivant. "Design and implementation of proximal planning and control of an unmanned ground vehicle to operate in dynamic environments." IEEE Transactions on Intelligent Vehicles 8.2 (2022): 1787-1799. (Year: 2022).*

Shah, Umer Hameed, et al. "On the design and development of vision-based tactile sensors." Journal of Intelligent & Robotic Systems 102.4 (2021): 82. (Year: 2021).*

The International Search Report for the corresponding international application No. PCT/JP2022/022150, issued on Jul. 26, 2022.

* cited by examiner

WORK MACHINE AND METHOD FOR CONTROLLING WORK MACHINE

CROSS-REFERENCE TO RELATED APPLICATIONS

This application is a U.S. National stage application of International Application No. PCT/JP2022/022150, filed on May 31, 2022. This U.S. National stage application claims priority under 35 U.S.C. § 119(a) to Japanese Patent Application No. 2021-108991, filed in Japan on Jun. 30, 2021, the entire contents of which are hereby incorporated herein by reference.

BACKGROUND

The present invention relates to a work machine and a method for controlling a work machine.

BACKGROUND INFORMATION

Some work machines are provided with a blade and perform work such as digging work with the blade. For example, a work machine in Japanese Patent Application Publication No. 2018-197425 performs digging work by a controller causing the blade to move according to a design surface. The controller also determines whether a slip occurs on a travel device of the work machine. The controller raises the design surface upon determining that the slip occurs. The controller raises the blade according to the design surface. As a result, a load to the blade decreases, whereby the work machine escapes from the slip.

SUMMARY

The aforementioned work machine causes the blade to perform a lift motion and thus raises the blade when a slip occurs during digging work. This allows the work machine to escape from the slip, but the amount of soil dug by the blade decreases. In this case, the work efficiency in digging decreases. An object of the present invention is to suppress an occurrence of slip in a work machine and to suppress a decrease in work efficiency.

A work machine according to one aspect of the present invention includes a vehicle body, a blade, a pitch actuator, and a controller. The vehicle body includes a travel device. The blade is supported so as to be rotatable about a pitch axis with respect to the vehicle body. The pitch actuator causes the blade to perform a pitch motion about the pitch axis. The controller determines whether a slip occurs on the travel device during work with the blade. The controller causes the blade to perform the pitch motion in a backward tilt direction upon determining that the slip occurs.

A method according to another aspect of the present invention is a method for controlling a work machine. The work machine includes a vehicle body, a blade, and a pitch actuator. The vehicle body includes a travel device. The blade is supported so as to be rotatable about a pitch axis with respect to the vehicle body. The pitch actuator causes the blade to perform a pitch motion about the pitch axis. The method according to the present aspect includes determining whether a slip occurs on the travel device during work with the blade, and causing the blade to perform the pitch motion in a backward tilt direction upon determining that the slip occurs.

According to the present invention, when it is determined that a slip occurs, the blade performs the pitch motion in the backward tilt direction. Accordingly, the resistance to the blade is reduced, whereby the work machine can escape from the slip. Further, since the work machine can be escaped from the slip not by the lift motion but by the pitch motion of the blade, the blade can be prevented from rising. This suppresses a decrease in work efficiency.

DETAILED DESCRIPTION OF EMBODIMENT(S)

Figure 1:
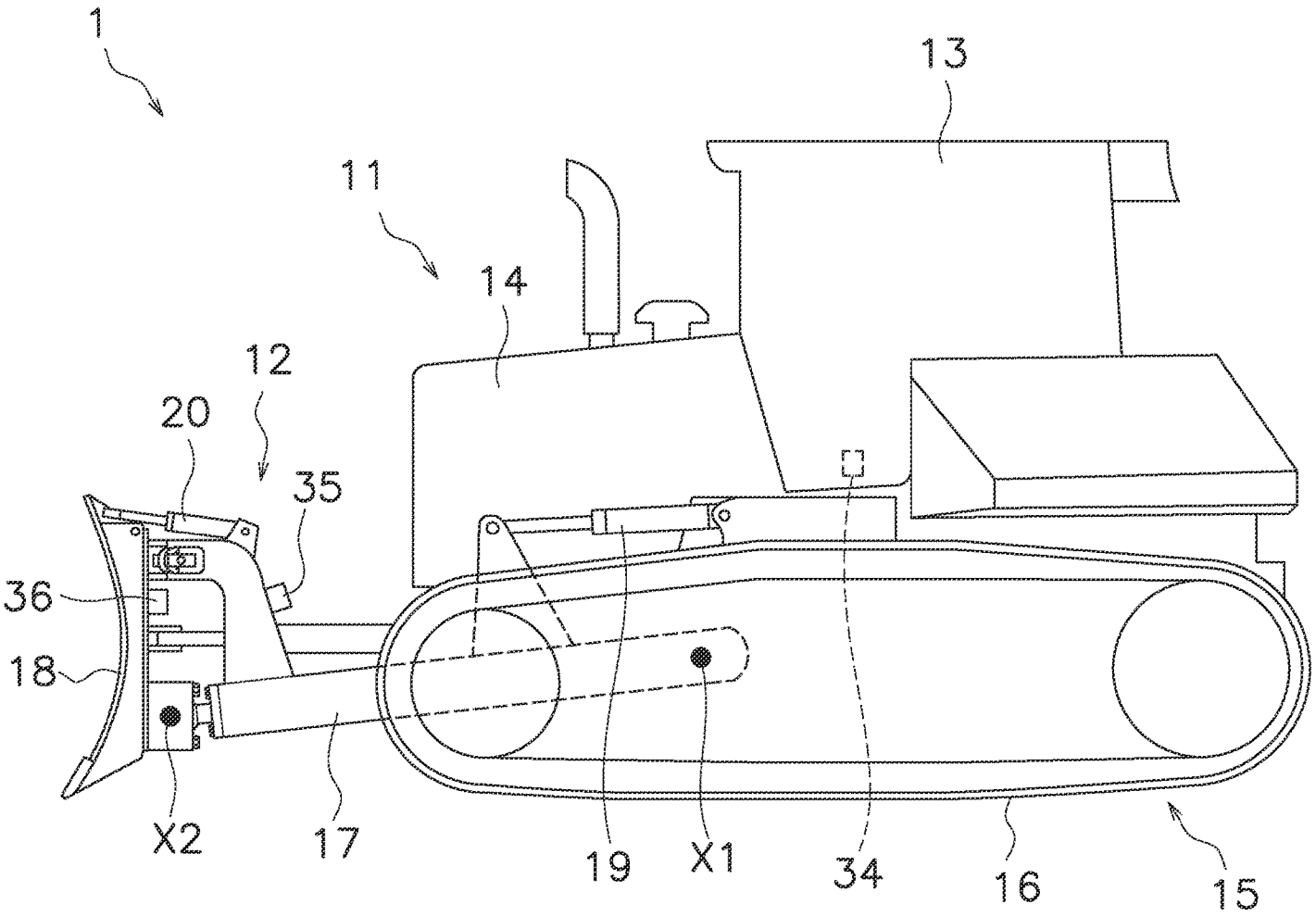
FIG. 1 is a side view of a work machine according to an embodiment.

A work machine according to an embodiment will be described below with reference to the drawings. FIG. 1 is a side view of a work machine 1 according to the embodiment. The work machine 1 according to the present embodiment is a bulldozer. The work machine 1 includes a vehicle body 11 and a work implement 12.

The vehicle body 11 includes an operating cabin 13, an engine compartment 14, and a travel device 15. An operator's seat that is not illustrated is disposed in the operating cabin 13. The engine compartment 14 is disposed in front of the operating cabin 13. The travel device 15 is provided at a lower portion of the vehicle body 11. The travel device 15 includes a pair of left and right crawler belts 16. Only the left crawler belt 16 is illustrated in FIG. 1. The work machine 1 travels due to the rotation of the crawler belts 16.

The work implement 12 is attached to the vehicle body 11. The work implement 12 includes a lift frame 17, a blade 18, a lift actuator 19, and a pitch actuator 20. The lift frame 17 is supported so as to be rotatable about a lift axis X1 with respect to the vehicle body 11. The lift axis X1 extends in a lateral direction of the vehicle body 11. The lift frame 17 rotates about the lift axis X1, thereby performing a lift motion up and down. The lift frame 17 may be attached to the travel device 15. The lift frame 17 may be disposed at an inner side of the travel device 15 or may be disposed at an outer side of the travel device 15.

The blade 18 is disposed in front of the vehicle body 11. The blade 18 is supported so as to be rotatable about a pitch axis X2 with respect to the lift frame 17. The pitch axis X2 extends in the lateral direction of the vehicle body 11. The blade 18 rotates about the pitch axis X2, thereby performing a pitch motion forward and backward. The blade 18 moves up and down accompanying the up and down motions of the lift frame 17.

The lift actuator 19 is coupled to the vehicle body 11 and the lift frame 17. The lift actuator 19 is a hydraulic cylinder. Due to the extension and contraction of the lift actuator 19, the lift frame 17 performs the lift motion up and down. The lift actuator 19 contracts, thereby causing the blade 18 to be raised. The lift actuator extends, thereby causing the blade 18 to be lowered. The lift actuator 19 may be attached to the blade 18.

The pitch actuator 20 is coupled to the lift frame 17 and the blade 18. The pitch actuator 20 is a hydraulic cylinder. Due to the extension and contraction of the pitch actuator 20, the blade 18 performs the pitch motion forward and backward. A portion of the blade 18, for example, its upper end moves forward and backward, thereby causing the blade 18 to perform the pitch motion about the pitch axis X2. The pitch actuator 20 extends, thereby causing the blade 18 to be tilted forward. The pitch actuator 20 contracts, thereby causing the blade 18 to be tilted backward.

Figure 2:
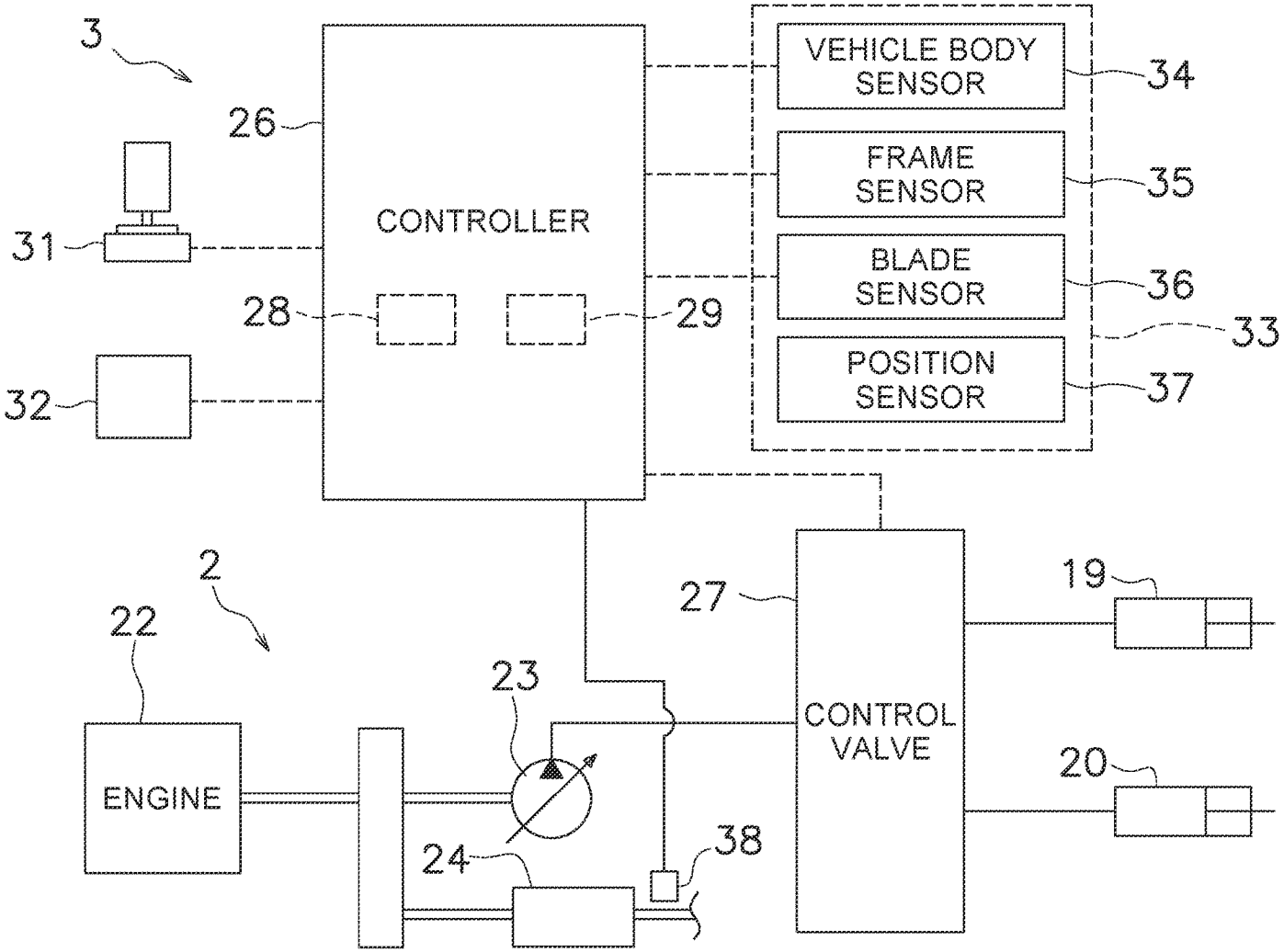
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23 and a power transmission device 24. The hydraulic pump 23 is driven by the engine 22 to discharge hydraulic fluid. The hydraulic fluid discharged from the hydraulic pump 23 is supplied to the lift actuator 19 and the pitch actuator 20. Although one hydraulic pump is illustrated in FIG. 2, a plurality of hydraulic pumps may be provided.

The power transmission device 24 transmits driving force of the engine 22 to the travel device 15. The power transmission device 24 may be a hydro static transmission (HST), for example. Alternatively, the power transmission device 24 may be, for example, a transmission having a torque converter or a plurality of transmission gears.

The control system 3 includes a controller 26 and a control valve 27. The controller 26 is programmed to control the work machine 1 based on acquired data. The controller 26 includes a storage device 28 and a processor 29. The processor 29 includes a CPU, for example. The storage device 28 includes a memory and an auxiliary storage device, for example. The storage device 28 may be a RAM or a ROM, for example. The storage device 28 may be a semiconductor memory, a hard disk, or the like. The storage device 28 is an example of a non-transitory computer-readable recording medium. The storage device 28 stores computer instructions that are executable by the processor 29 and for controlling the work machine 1.

The control valve 27 is a proportional control valve and is controlled by a command signal from the controller 26. The control valve 27 is disposed between the hydraulic pump 23 and a hydraulic actuator such as the lift actuator 19 and the pitch actuator 20. The control valve 27 controls the flow rate of the hydraulic fluid supplied from the hydraulic pump 23 to the lift actuator 19. The control valve 27 controls the flow rate of the hydraulic fluid supplied from the hydraulic pump 23 to the pitch actuator 20. The control valve 27 may be a pressure proportional control valve. Alternatively, the control valve 27 may be an electromagnetic proportional control valve.

The control system 3 includes an operating device 31 and an input device 32. The operating device 31 includes a lever, for example. Alternatively, the operating device 31 may include a pedal or a switch. An operator can manually operate the travel of the work machine 1 and the motion of the work implement 12 using the operating device 31. The operating device 31 outputs an operation signal indicative of an operation of the operating device 31. The controller 26 receives the operation signal from the operating device 31.

The operating device 31 is configured to operate the lift motion of the blade 18. Specifically, the operating device 31 is configured to operate a raising operation and a lowering operation of the blade 18. When the operator performs the raising operation on the operating device 31, the controller 26 controls the lift actuator 19 so that the blade 18 is raised. When the operator performs the lowering operation on the operating device 31, the controller 26 controls the lift actuator 19 so that the blade 18 is lowered.

Figure 3:
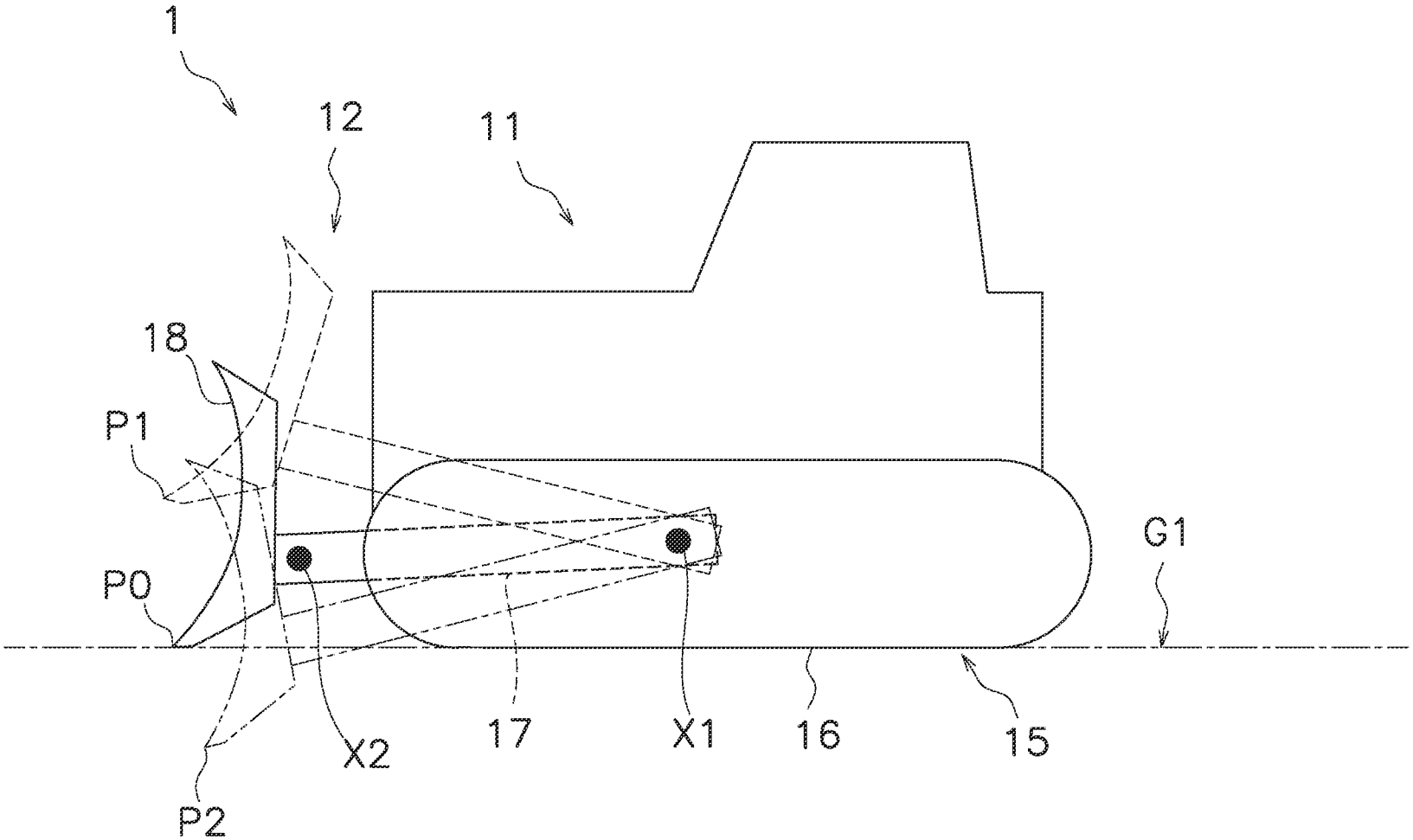
FIG. 3 is a view illustrating a lift motion of a blade.

FIG. 3 is a schematic view illustrating the lift motion of the work machine 1. In FIG. 3, P0 indicates a current position of a blade tip of the blade 18. P1 indicates the highest position of the blade tip of the blade 18. P2 indicates the lowest position of the blade tip of the blade 18. The work machine 1 can cause the blade 18 to perform the lift motion between the highest position P1 and the lowest position P2.

The operating device 31 is configured to operate the pitch motion of the blade 18. Specifically, the operating device 31 is configured to operate a forward tilt operation and a backward tilt operation of the blade 18. When the operator performs the forward tilt operation on the operating device 31, the controller 26 controls the pitch actuator 20 so that the blade 18 is tilted forward. When the operator performs the backward tilt operation on the operating device 31, the controller 26 controls the pitch actuator 20 so that the blade 18 is tilted backward.

Figures 4A, 4B, 4C:
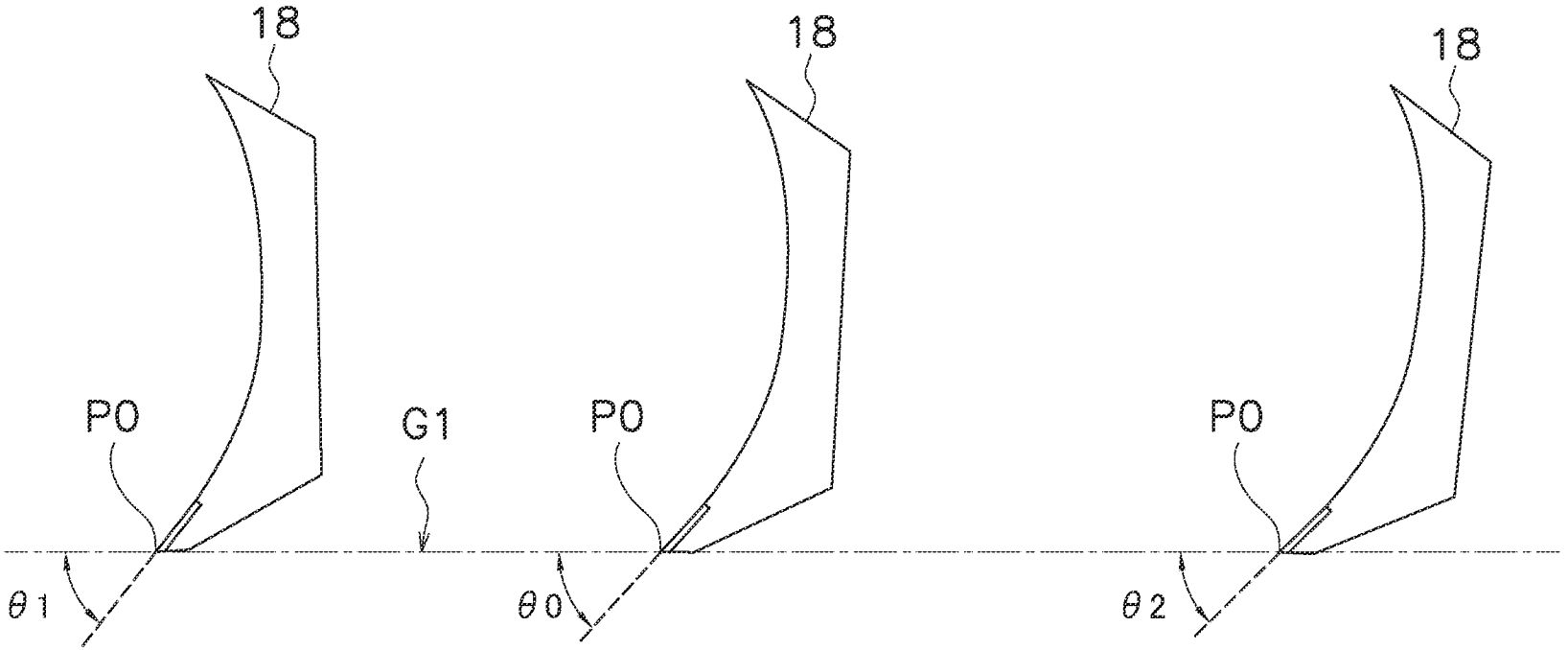
FIG. 4A, FIG. 4B and FIG. 4C are views illustrating a pitch motion of the blade.

FIGS. 4A to 4C are views illustrating pitch angles of the blade 18. As illustrated in FIGS. 4A to 4C, pitch angles θ0 to θ2 of the blade 18 are the angles between the blade tip of the blade 18 and a ground contact surface G1 of the crawler belts 16. FIG. 4B illustrates a pitch angle θ0 of the blade 18 in a normal state (hereinafter referred to as a "normal pitch angle"). FIG. 4A illustrates a pitch angle θ1 of the blade 18 tilted forward relative to the normal state. FIG. 4C illustrates a pitch angle θ2 of the blade 18 tilted backward relative to the normal state. The pitch angle increases as the blade 18 is tilted forward. The pitch angle decreases as the blade 18 is tilted backward. That is, the following formula $\theta 1>\theta 0>\theta 2$ is satisfied.

The operating device 31 may be a hydraulic pilot type device. For example, the operating device 31 may output pilot hydraulic pressure according to the operation of the operating device 31. The control valve 27 is controlled by the pilot hydraulic pressure from the operating device 31, whereby the lift actuator 19 or the pitch actuator 20 may be controlled. The controller 26 may receive a signal indicative of the pilot hydraulic pressure as the operation signal.

The input device 32 includes a touch screen, for example. The input device 32 may include another device such as a switch. The operator can set a control mode of the pitch angle of the blade 18 by the controller 26 using the input device 32. The control mode includes a manual mode and an automatic control. In the manual mode, the operator can manually change the pitch angle of the blade 18 using the operating device 31. The automatic control of the pitch angle will be described later in detail.

As illustrated in FIG. 2, the control system 3 includes a sensor 33 that detects a current position of the blade tip of the blade 18 (hereinafter referred to as a "blade tip position P0"). The sensor 33 includes a vehicle body sensor 34, a frame sensor 35, a blade sensor 36, and a position sensor 37. The vehicle body sensor 34 is attached to the vehicle body 11. The vehicle body sensor 34 detects a posture of the vehicle body 11. The frame sensor 35 is attached to the lift frame 17. The frame sensor 35 detects a posture of the lift frame 17. The blade sensor 36 is attached to the blade 18. The blade sensor 36 detects a posture of the blade 18. The position sensor 37 detects a current position of the vehicle body 11.

The vehicle body sensor 34, the frame sensor 35, and the blade sensor 36 are inertial measurement units (IMU). However, the frame sensor 35 and the blade sensor 36 are not limited to the IMU and may be another sensor such as an angle sensor, a cylinder stroke sensor, or the like.

The vehicle body sensor 34 detects an angle in a front-back direction of the vehicle body 11 with respect to the horizontal (vehicle pitch angle). The frame sensor 35 detects a rotation angle of the lift frame 17. The blade sensor 36 detects the pitch angle of the blade 18. The vehicle body sensor 34, the frame sensor 35, and the blade sensor 36 output detection signals indicative of the angles detected by the respective sensors.

The position sensor 37 is, for example, a position sensor of a global navigation satellite system (GNSS) such as a global positioning system (GPS). The position sensor 37 includes, for example, a GNSS receiver and an antenna. The position sensor 37 detects a current position of the position sensor 37. The position sensor 37 is disposed on the vehicle body 11. Accordingly, the position sensor 37 detects the current position of the vehicle body 11. The current position of the vehicle body 11 is indicated by global coordinates with the earth as a reference. However, the current position of the vehicle body 11 may be indicated by local coordinates with a work site where the work machine 1 performs work as a reference. The controller 26 acquires the detection signal indicative of the current position of the vehicle body 11 from the position sensor 37.

The controller 26 receives the detection signals from the vehicle body sensor 34, the frame sensor 35, the blade sensor 36, and the position sensor 37. The controller 26 stores machine dimension data indicative of the dimensions of the vehicle body 11, the lift frame 17, and the blade 18 and their positional relationship. The controller 26 calculates the blade tip position P0 of the blade 18 based on the angles detected by the vehicle body sensor 34, the frame sensor 35, and the blade sensor 36, respectively, the current position of the vehicle body 11 detected by the position sensor 37, and the machine dimension data.

The work machine 1 includes a speed sensor 38. The speed sensor 38 detects a moving speed of the travel device 15. The speed sensor 38 outputs a detection signal indicative of the moving speed of the travel device 15. The controller 26 acquires the detection signal indicative of the moving speed of the travel device 15 from the speed sensor 38. For example, the speed sensor 38 detects a rotational speed of an output axis of the power transmission device 24. The controller 26 calculates the moving speed of the crawler belts 16 from the rotational speed of the output axis of the power transmission device 24. Alternatively, the speed sensor 38 may detect a rotational speed of another rotating element of the power transmission device 24. Alternatively, the speed sensor 38 may detect a rotational speed of a rotating element of the travel device 15, such as a sprocket. Alternatively, the speed sensor 38 may detect an engine rotational speed.

Figure 5:
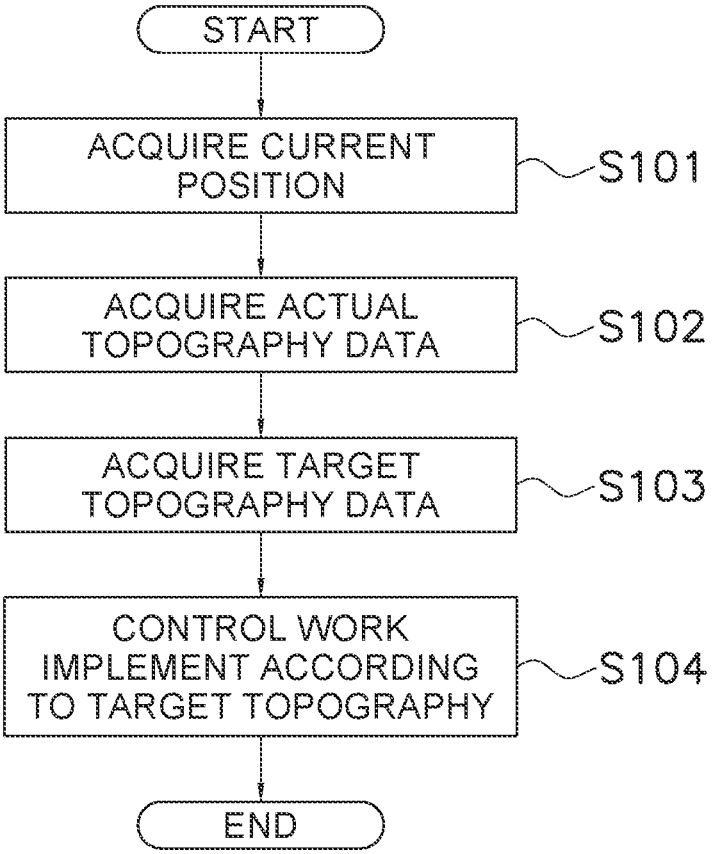
FIG. 5 is a flowchart illustrating an automatic control of the work machine according to a first embodiment.

The controller 26 automatically controls the work machine 1. The automatic control of the work machine 1 performed by the controller 26 will be described below. FIG. 5 is a flowchart illustrating processes of the automatic control.

As illustrated in FIG. 5, in step S101, the controller 26 acquires a current position of the work machine 1. At this time, the controller 26 acquires the blade tip position P0 of the blade 18 described above as the current position of the work machine 1.

Figure 6:
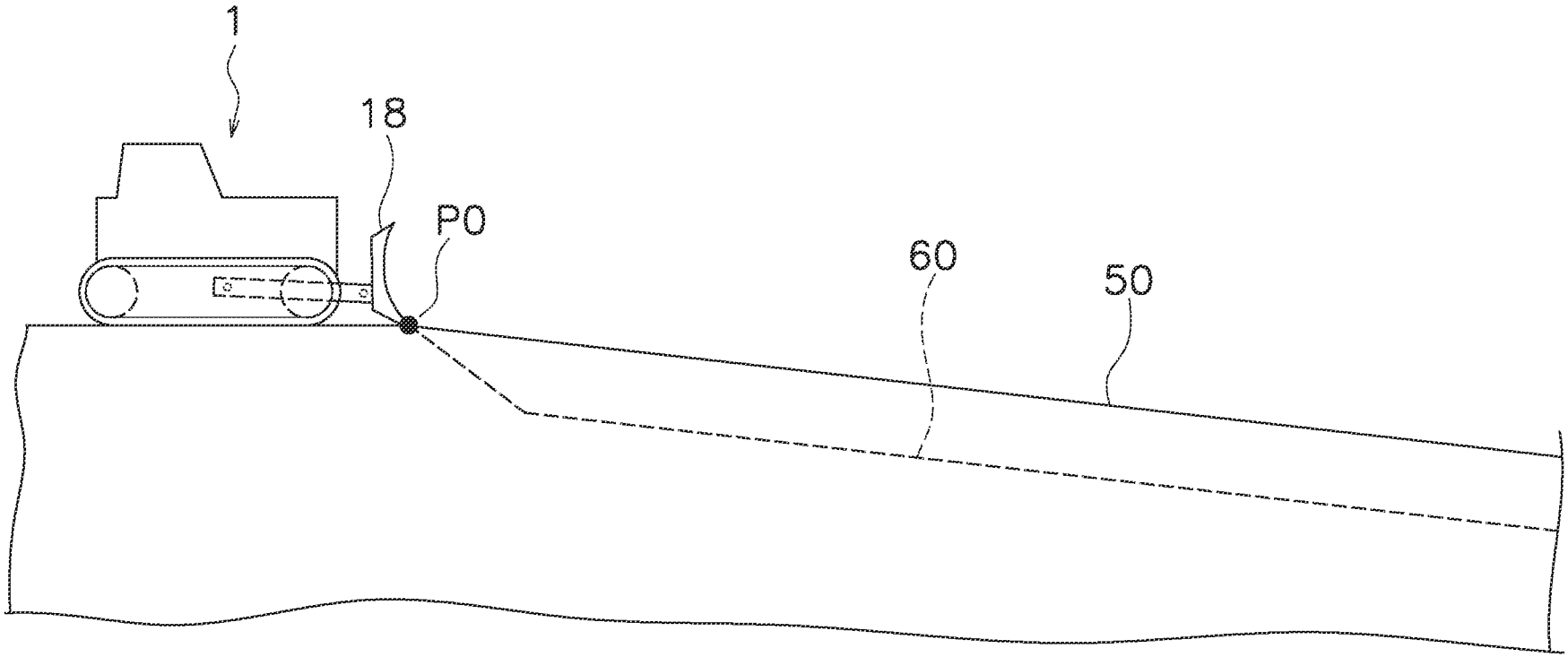
FIG. 6 is a view illustrating an example of an actual topography and a target topography.

In step S102, the controller 26 acquires actual topography data. The actual topography data indicates an actual topography 50 to be worked. FIG. 6 is a view illustrating an example of the actual topography 50. The actual topography data includes coordinates and heights of a plurality of points on the actual topography 50 positioned in a traveling direction of the work machine 1. The controller 26 may acquire the actual topography data from an external computer. The controller 26 may acquire the actual topography data updated with a trajectory of a bottom surface of the crawler belts 16.

In step S103, the controller 26 acquires target topography data. The target topography data indicates a target topography 60 with respect to the actual topography 50. The target topography data includes coordinates and heights of a plurality of points on the target topography 60 positioned in the traveling direction of the work machine 1. As illustrated in FIG. 6, at least a portion of the target topography 60 is vertically displaced with respect to the actual topography 50. At least a portion of the target topography 60 is positioned below the actual topography 50.

The controller 26 may determine the target topography 60 based on the actual topography 50. For example, the controller 26 may determine the target topography 60 by displacing the actual topography 50 downward. The controller 26 may determine, as the target topography 60, a trajectory extending at a predetermined angle from a predetermined start position of work. The controller 26 may determine the target topography 60 based on the capacity of the blade 18 or a load applied to the blade 18. The controller 26 may determine the target topography 60 based on the amount of soil held by the blade 18. Alternatively, the controller 26 may acquire the target topography data from an external computer.

In step S104, the controller controls the work implement 12 according to the target topography 60. The controller 26 controls the lift actuator 19 so that the blade tip of the blade 18 moves according to the target topography 60. Accordingly, the blade 18 performs the lift motion up and down so that the blade tip of the blade 18 moves along the target topography 60 while the work machine 1 travels forward. As a result, the actual topography 50 is dug by the blade 18. The forward travel of the work machine 1 may be manually performed by the operator operating the operating device 31. Alternatively, the forward travel of the work machine 1 may be performed with the automatic control by the controller 26.

Figure 7:
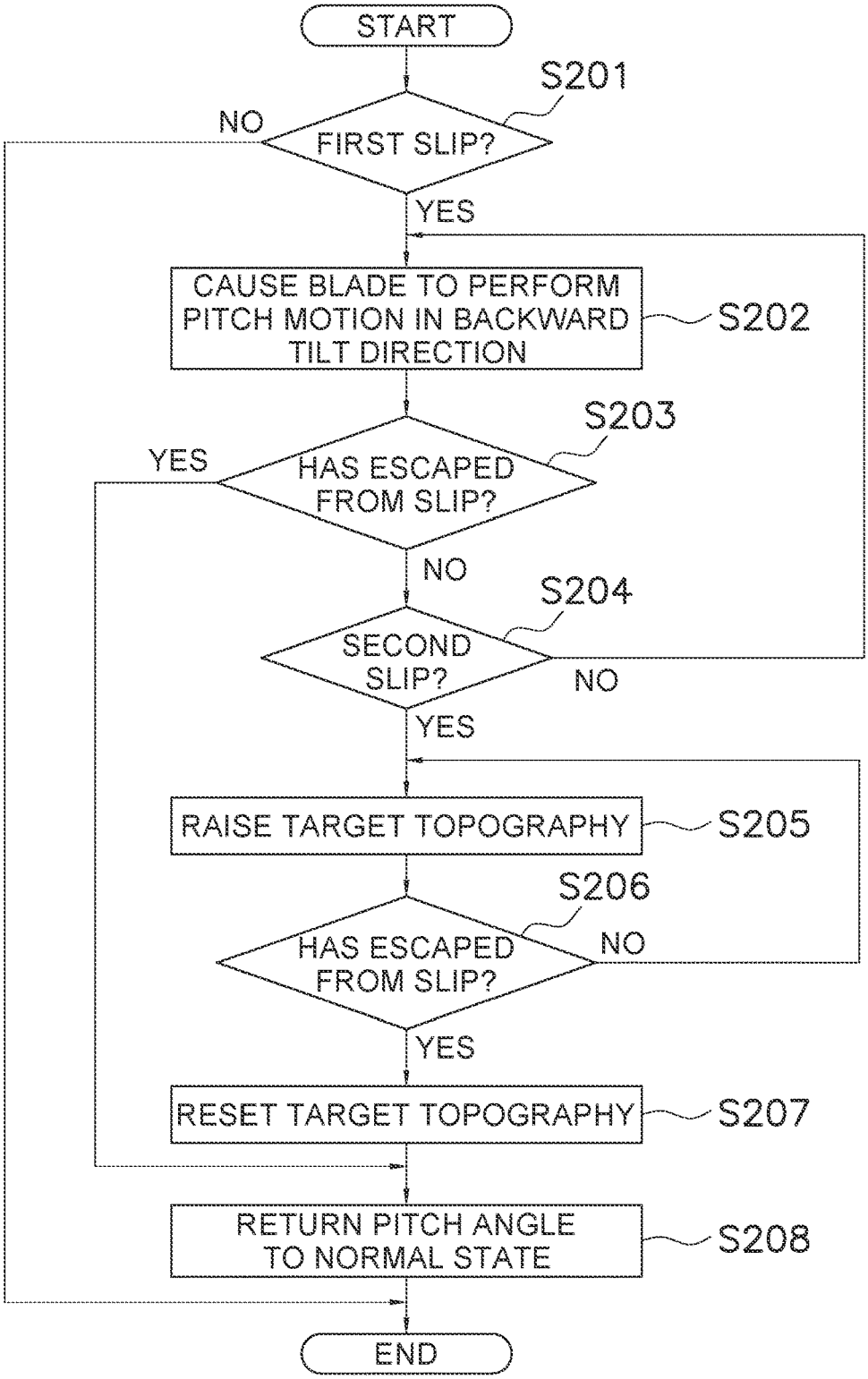
FIG. 7 is a flowchart illustrating processes for suppressing an occurrence of slip.

In the work machine 1 according to the present embodiment, the controller 26 monitors an occurrence of slip on the travel device 15 while performing the automatic control of the height of the blade 18 according to the target topography 60. When a slip occurs, the controller 26 performs the automatic control of the pitch angle of the blade 18 in order to suppress the slip. FIG. 7 is a flowchart illustrating processes of a control for suppressing a slip.

As illustrated in FIG. 7, in step S201, the controller 26 performs a first slip determination. In the first slip determination, the controller 26 determines that a slip on the crawler belts 16 occurs when a first slip condition is satisfied. The first slip condition is that a slip ratio is less than a first threshold. The slip ratio is the ratio of an actual vehicle speed with respect to a theoretical vehicle speed of the vehicle body 11. The controller 26 calculates the theoretical vehicle speed of the vehicle body 11 based on the moving speed of the travel device 15. The controller 26 calculates the actual vehicle speed of the vehicle body 11 based on a position of the vehicle body 11. That is, the first slip condition is represented by the following formula (1).

$$Rs=Va/Vt<Th1$$

Rs is the slip ratio. Va is the actual vehicle speed. Vt is the theoretical vehicle speed. Th1 is the first threshold.

The first slip condition may include that the theoretical vehicle speed does not increase. When the controller 26 determines that the slip occurs in step S201, the process proceeds to step S202.

Figure 8:
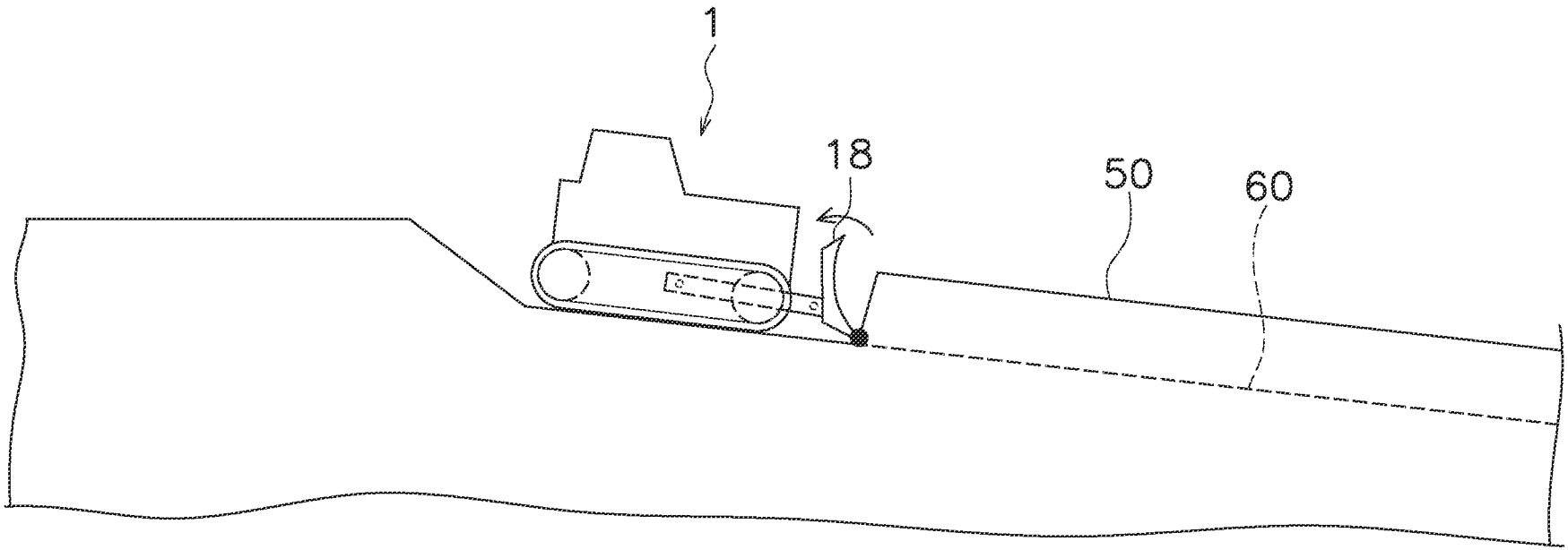
FIG. 8 is a view illustrating the pitch motion of the blade when a slip occurs.

In step S202, the controller 26 causes the blade 18 to perform the pitch motion in a backward tilt direction as illustrated in FIG. 8. For example, the controller 26 decreases the pitch angle of the blade 18 by a predetermined angle. The predetermined angle may be a constant value. Alternatively, the predetermined angle may be an angle according to a parameter such as the slip ratio, a load applied to the blade 18, or the like.

In step S203, the controller 26 determines whether the travel device 15 has escaped from the slip. The controller 26 determines that the travel device 15 has escaped from the slip when a first slip escape condition is satisfied. The first slip escape condition is that the slip ratio is greater than or equal to the first threshold. The controller 26 determines that the travel device 15 has escaped from the slip when the first slip escape condition is satisfied.

When the controller 26 determines that the travel device 15 has escaped from the slip in step S203, the controller 26 continues the control of the blade 18 according to the target topography 60 as described above after returning the pitch angle to the normal state in step S208. When the controller 26 determines that the travel device 15 has not escaped from the slip in step S203, the process proceeds to step S204.

In step S204, the controller 26 performs a second slip determination. In the second slip determination, the controller 26 determines whether a slip occurs on the travel device 15 when a second slip condition is satisfied. The second slip condition is that the theoretical vehicle speed is greater than a second threshold. When the controller 26 determines that the slip occurs, the process proceeds to step S205.

Figure 9:
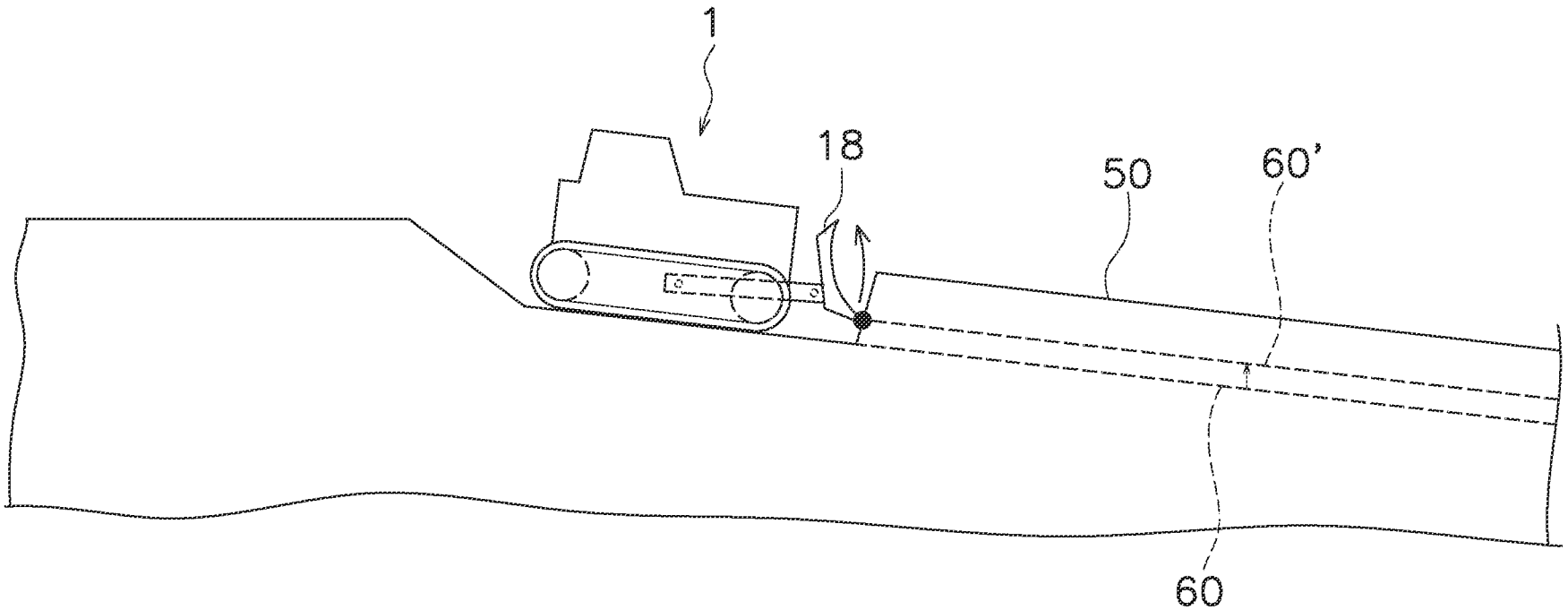
FIG. 9 is a view illustrating the lift motion of the blade when not escaping from the slip after the pitch motion.

In step S205, the controller 26 raises the target topography 60 as illustrated in FIG. 9. Accordingly, the controller 26 raises the blade 18. The controller 26 may raise the blade 18 while continuing the pitch motion of the blade 18. In step S206, the controller 26 determines whether the travel device 15 has escaped from the slip. At this time, the controller 26 determines that the travel device 15 has escaped from the slip when a second slip escape condition is satisfied. The second slip escape condition is that the theoretical vehicle speed is less than or equal to the second threshold. When the controller 26 determines that the travel device 15 has not escaped from the slip in step S206, the process returns to step S205. Therefore, the controller 26 continuously raises the target topography 60.

When the controller 26 determines that the travel device 15 has escaped from the slip in step S206, the process proceeds to step S207. In step S207, the controller 26 resets the target topography 60. The controller 26 resets, as the new target topography 60, a target topography 60' when determined that the travel device 15 has escaped from the slip. Then, the controller 26 continues the control of the blade 18 according to the reset target topography 60. In step S208, the controller 26 returns the pitch angle to the normal state.

In the work machine 1 according to the present embodiment as described above, when it is determined that a slip occurs, the blade 18 performs the pitch motion in the backward tilt direction. Accordingly, the digging resistance to the blade 18 is reduced, whereby the travel device 15 can escape from the slip. Further, since the travel device 15 is escaped from the slip not by the lift motion but by the pitch motion of the blade 18, the blade 18 can be prevented from rising. This suppresses a decrease in work efficiency.

Although one embodiment of the present invention has been described above, the present invention is not limited to the above embodiment and various modifications can be made without departing from the gist of the invention.

The work machine 1 is not limited to a bulldozer and may be another vehicle such as a wheel loader, a motor grader, or the like. The controller 26 may have a plurality of controllers separate from each other. A portion of the plurality of controllers may be disposed outside of the work machine 1. That is, the work machine 1 may be remotely controlled. The processes by the controller 26 are not limited to those of the above embodiment and may be changed. A portion of the aforementioned processes of the automatic control may be omitted. Alternatively, a portion of the aforementioned processes may be changed.

The lift actuator 19 and the pitch actuator 20 are not limited to hydraulic cylinders. The lift actuator 19 and the pitch actuator 20 may be another actuator such as an electric motor, for example. The position sensor 37 may be disposed on another part of the work machine 1 instead of the vehicle body 11. For example, the position sensor 37 may be disposed on the blade 18.

The processes of the control for suppressing the slip are not limited to the aforementioned processes and may be changed. For example, the processes for determining the occurrence of slip and for determining the escape from the slip are not limited to the aforementioned processes and may be changed. The controller 26 may directly raise the blade 18 without raising the target topography 60 upon determining that the slip occurs.

The theoretical vehicle speed may be calculated from a change per unit time in position of the vehicle body 11 acquired by the position sensor 37. Alternatively, the theoretical vehicle speed may be calculated from the integrated value of acceleration of the vehicle body 11 acquired by the vehicle body sensor 34. Alternatively, the theoretical vehicle speed may be calculated from a change per unit time in position of an external object acquired from the vehicle body 11 by a positioning means such as a radar.

According to the present invention, it is possible to suppress an occurrence of slip in a work machine and suppress a decrease in work efficiency.

The invention claimed is:

1. A work machine comprising:

a vehicle body including a travel device;

a blade supported so as to be rotatable about a pitch axis with respect to the vehicle body;

a pitch actuator configured to cause the blade to perform a pitch motion about the pitch axis; and a controller configured to determine, based on a first slip condition, whether a first slip occurs on the travel device during work with the blade, cause the blade to perform the pitch motion in a backward tilt direction upon determining that the first slip occurs, determine whether the travel device has escaped from the first slip, upon determining that the travel device has not escaped from the first slip, determine, based on a second slip condition different from the first slip condition, whether a second slip is occurring on the travel device during work with the blade, and raise the blade upon determining that the second slip is occurring.

2. A method for controlling a work machine that includes a vehicle body including a travel device, a blade supported so as to be rotatable about a pitch axis with respect to the vehicle body, and a pitch actuator configured to cause the blade to perform a pitch motion about the pitch axis, the method comprising:

determining, based on a first slip condition, whether a first slip occurs on the travel device during work with the blade;

causing the blade to perform the pitch motion in a backward tilt direction upon determining that the first slip occurs;

determining whether the travel device has escaped from the first slip;

upon determining that the travel device has not escaped from the first slip, determining, based on a second slip condition different from the first slip condition, whether a second slip is occurring on the travel device during work with the blade; and raising the blade upon determining that the second slip is occurring.

3. The work machine according to claim 1, further comprising:

a lift frame supported so as to be rotatable about a lift axis with respect to the vehicle body; and a lift actuator configured to cause the lift frame to perform a lift motion up and down about the lift axis, the blade being supported by the vehicle body via the lift frame, and the controller being configured to acquire actual topography data indicative of an actual topography on which the work is performed, acquire target topography data indicative of a target topography, at least a portion of the target topography being positioned below the actual topography, and perform the work by controlling the lift actuator so that a blade tip of the blade moves according to the target topography.

4. The work machine according to claim 1, further comprising:

a position sensor configured to detect a position of the vehicle body; and a speed sensor configured to detect a moving speed of the travel device, the controller being further configured to calculate an actual vehicle speed of the work machine based on the position of the vehicle body, calculate a theoretical vehicle speed of the work machine based on the moving speed of the travel device, and determine whether the first slip occurs on the travel device based on the actual vehicle speed and the theoretical vehicle speed.

5. The method according to claim 2, wherein the work machine includes a lift frame supported so as to be rotatable about a lift axis with respect to the vehicle body, and a lift actuator configured to cause the lift frame to perform a lift motion up and down about the lift axis, the blade is supported by the vehicle body via the lift frame, and the method further comprises:

acquiring actual topography data indicative of an actual topography on which the work is performed;

acquiring target topography data indicative of a target topography, at least a portion of the target topography being positioned below the actual topography; and performing the work by controlling the lift actuator so that a blade tip of the blade moves according to the target topography.

6. The method according to claim 2, further comprising:

acquiring a position of the vehicle body;

acquiring a moving speed of the travel device;

calculating an actual vehicle speed of the work machine based on the position of the vehicle body;

calculating a theoretical vehicle speed of the work machine based on the moving speed of the travel device; and determining whether the first slip occurs on the travel device based on the actual vehicle speed and the theoretical vehicle speed.

* * * * *